US009319817B2

(12) United States Patent
Baer et al.

(10) Patent No.: US 9,319,817 B2
(45) Date of Patent: Apr. 19, 2016

(54) TIP-PLATE ASSEMBLY, HEARING DEVICE WITH A TIP-PLATE ASSEMBLY AND METHOD OF MANUFACTURING A HEARING DEVICE WITH A TIP-PLATE ASSEMBLY

(75) Inventors: Daniel Baer, Winterthur (CH); Roland Hug, Hinwil (CH); Jonas Meyer, Stafa (CH)

(73) Assignee: SONOVA AG, Staefa (CH)

( * ) Notice: Subject to any disclaimer, the term of this patent is extended or adjusted under 35 U.S.C. 154(b) by 0 days.

(21) Appl. No.: 14/359,408

(22) PCT Filed: Dec. 23, 2011

(86) PCT No.: PCT/EP2011/073951

§ 371 (c)(1), (2), (4) Date: May 20, 2014

(87) PCT Pub. No.: WO2013/091724

PCT Pub. Date: Jun. 27, 2013

(65) Prior Publication Data

US 2014/0301585 A1 Oct. 9, 2014

(51) Int. Cl.
*H04R 25/00* (2006.01)
*H04R 31/00* (2006.01)

(52) U.S. Cl.
CPC ..... *H04R 31/00* (2013.01); *H04R 25/604* (2013.01); *H04R 25/652* (2013.01); *H04R 25/658* (2013.01); *H04R 25/608* (2013.01); *H04R 2225/025* (2013.01); *Y10T 29/49005* (2015.01)

(58) Field of Classification Search
CPC .. H04R 25/652; H04R 25/604; H04R 25/658; H04R 25/608; H04R 2225/025
See application file for complete search history.

(56) References Cited

U.S. PATENT DOCUMENTS

| | | | | |
|---|---|---|---|---|
| 7,443,993 | B2 * | 10/2008 | Gunnersen et al. | 381/329 |
| 2006/0153418 | A1 | 7/2006 | Van Halteren | |
| 2007/0183612 | A1 | 8/2007 | Ochsenbein | |
| 2008/0181440 | A1 | 7/2008 | Saltykov | |

FOREIGN PATENT DOCUMENTS

| | | | |
|---|---|---|---|
| EP | 1 978 783 | A2 | 10/2008 |
| EP | 2 091 267 | A1 | 8/2009 |
| WO | 2010/147554 | A1 | 12/2010 |

OTHER PUBLICATIONS

International Search Report issued in Application No. PCT/EP2011/073951 dated Jul. 26, 2012. Written Opinion issued in Application No. PCT/EP2011/073951 dated Jul. 26, 2012.

* cited by examiner

*Primary Examiner* — Tuan D Nguyen
(74) *Attorney, Agent, or Firm* — Pearne & Gordon LLP

(57) ABSTRACT

The present invention provides a tip-plate assembly for arrangement at a proximal end portion of a hearing device to be worn at least partially within an ear canal such that said proximal end portion faces towards an ear drum. Said tip-plate assembly comprises a tip-plate (9) having a seating aperture (10), a receiver module (5) having a sound output port (6) at a front end (11), and a suspension element (12). Said suspension element (12) at least partly envelopes said receiver module (5) at said front end (11) and said receiver module (5) is mounted in said seating aperture (10) by means of said suspension element (12). Said tip-plate assembly may further comprise a microphone module (15). Moreover, a hearing device comprising such a tip-plate assembly is given, and a method of manufacturing a hearing device comprising such a tip-plate assembly is proposed.

17 Claims, 2 Drawing Sheets

TIP-PLATE ASSEMBLY, HEARING DEVICE WITH A TIP-PLATE ASSEMBLY AND METHOD OF MANUFACTURING A HEARING DEVICE WITH A TIP-PLATE ASSEMBLY

TECHNICAL FIELD

The present invention relates to hearing devices for being worn at least partially within an ear canal. More specifically the present invention pertains to a tip-plate assembly intended for use with such a hearing device, a hearing device with such a tip-plate assembly as well as a method of manufacturing a hearing device with such a tip-plate.

BACKGROUND OF THE INVENTION

In the context of the present invention the term "hearing device" refers to hearing aids (alternatively called hearing instruments or hearing prostheses) used to compensate hearing impairments of hard of hearing persons as well as audio and communication devices used to provide sound signals to persons with normal hearing capability, e.g. in order to improve hearing in harsh acoustic surroundings. Moreover, it also encompasses ear-level hearing protection devices, which safeguard a user from damaging his sense of hearing when subjected to severe acoustic shock events such as for instance gunfire or when exposed to excessive noise or sound levels for prolonged periods of time. Combinations of the mentioned devices such as for example hearing protection devices including a communication capability are also regarded as hearing devices in connection with the present invention.

Known hearing devices of the type which are at least partially worn within an ear canal of a user comprise a shell which is adapted to the individual shape of the user's ear canal. Such hearing devices are available in different styles, for instance as in-the-ear (ITE), including in-the-canal (ITC) and completely-in-canal (CIC), as well as hybrid behind-the-ear/in-the-ear type hearing devices. In the latter case the hearing device consists of a component to be worn "behind the ear" (BTE, i.e. behind the pinna) and a component to be worn at least partially within the "ear" (i.e. within the ear canal), whereby the ITE component contains a receiver and the BTE component contains an amplifier along with the necessary signal processing circuitry. ITE type hearing devices comprise a microphone and a receiver, a battery, an electronics module and one or more user control elements. These components are housed in a custom shell shaped according to a portion of the user's ear canal, whereby the microphone and user control element(s) are arranged at a face-plate further comprising a battery door. The face-plate is affixed to the distal end of the shell, whereas the receiver is positioned at the proximal end and is connected, typically by means of an acoustic tube, to the sound opening of the shell facing towards the ear drum when the hearing device is being worn in the ear canal. Conventionally, the sound opening is covered by a wax protection member in order to prevent soiling of the receiver, for instance due to ear wax or sweat.

There are a number of problems associated with such ITE type hearing devices. Due to the limited cross-section of and the bends in the ear canal there is an acute lack of space within the shell to position the necessary components, especially the bulky receiver as well as for instance an additional "ear canal microphone" intended to pick up the sound emitted into the ear canal by the receiver (not to be confused with the one or more "ambient microphones" which pick up the sound from the surroundings of the hearing device user). In order to provide a high output sound pressure level larger receivers are required, and their increased size significantly limits the possible insertion depth of the hearing device into the ear canal. Moreover, the acoustic coupling of the receiver to the ear canal considerably depends on the acoustic tubing extending from the sound output port of the receiver to the proximal sound opening of the shell. The length of this tubing depends on the final position of the receiver within the shell, which is determined by the way in which all the components can be manually arranged within the limited space inside the shell by the person who individually assembles the hearing device. During the assembly process the electronics module to which the receiver is connected is inserted through a distal opening in the shell. In order to allow access with minimal obstruction and permit flexible positioning no seatings are provided within the shell for the various components. As a consequence the stated acoustic tubing also acts as a suspension for the receiver. Once positioned excess tubing extending beyond the proximal sound opening of the shell is simply cut off. In summary the "fit rate" of a custom hearing device (i.e. the probability that a certain user can be provided with a specific hearing device that meets his needs) is significantly limited in state of the art ITE hearing devices. This limitation becomes even more pronounced with the advent of ear canal microphones being used to measure the sound emitted by the receiver into the ear canal and for instance to determine the sound pressure level at the user's ear drum. Moreover, the acoustic coupling between the receiver and the ear canal and properties of the mechanical suspension of the receiver are not known due to the way in which state of the art ITE hearing devices are assembled. This reduces the performance achievable by such hearing devices, e.g. in terms of feedback or occlusion (for instance when active occlusion cancellation is being employed).

In an attempt to simplify the manufacturing of ITE hearing devices EP-A 1 287 721 provides a method of producing an ITE hearing device whereby a transducer arrangement is introduced from the end forming the acoustic output of the hearing device housing. The proposed method allows assembly of the transducer arrangement into the hearing device in an automated manner.

SUMMARY OF THE INVENTION

It is an object of the present invention to overcome at least some of the above indicated drawbacks of known hearing devices.

This object is achieved by providing a tip-plate assembly according to claim 1 for use with a hearing device for being worn at least partially within an ear canal.

Furthermore, this object is achieved by the hearing device according to claim 11 comprising such a tip-plate assembly.

Moreover, it is a further goal of the present invention to provide a simpler, more cost efficient method for manufacturing a hearing device.

This further goal is achieved by the manufacturing method according to claim 14.

Preferred embodiments are given in the dependent claims.

The present invention provides a tip-plate assembly for arrangement at a proximal end portion of a hearing device to be worn at least partially within an ear canal such that said proximal end portion faces towards an ear drum, said tip-plate assembly comprising:

- a tip-plate having a seating aperture;
- a receiver module having a sound output port at a front end; and
- a suspension element, wherein said suspension element at least partly envelopes said receiver module at said front end and said receiver module is mounted in said seating aperture by means of said suspension element.

In an embodiment of the tip-plate said seating aperture features a shoulder against which said front end and/or said suspension element are abutted.

In a further embodiment of the tip-plate said seating aperture features a collar against which said front end and/or said suspension element are abutted.

In a further embodiment the tip-plate assembly further comprises a microphone module having a sound input port at an anterior end, said microphone module being mounted in said seating aperture at said anterior end.

In a further embodiment of the tip-plate the suspension element and/or a further suspension element at least partly envelopes said microphone module at said anterior end and said microphone module is mounted in said seating aperture by means of said suspension element and/or said further suspension element.

In a further embodiment of the tip-plate said suspension element and said further suspension element are integrally formed and said microphone module is jointly mounted with said receiver module in said seating aperture by means of said integrally formed suspension element.

In a further embodiment of the tip-plate said receiver module and said microphone module are mounted such in said seating aperture that said receiver module and said microphone module are not in direct contact to one another.

In a further embodiment the tip-plate further comprises a wax protection member extending at least partly across the seating aperture.

In a further embodiment the tip-plate further comprises a vent opening.

In a further embodiment the tip-plate further comprises two optically distinguishable layers, preferably having different colours or different textures.

Furthermore, the present invention provides a hearing device for being worn at least partially within an ear canal, comprising a shell with a proximal opening and a tip-plate assembly as previously described, said tip-plate assembly being arranged at said proximal opening of said shell, said proximal opening being intended to face towards an ear drum when said hearing device is being worn.

In an embodiment of the hearing device said tip-plate assembly is attached at a periphery of said proximal opening by means of an adhesive or a mechanical snapping mechanism.

In further embodiments the hearing device is an in-the-ear, in-the-canal, completely-in-canal or hybrid behind-the-ear/in-the-ear type hearing device.

In a further aspect of the present invention a method of manufacturing an above described hearing device is proposed, the method comprising the steps of:

- manufacturing an above described tip-plate assembly to form a preassembled part;
- introducing said preassembled tip-plate assembly from the exterior of said shell into said proximal opening; and
- bonding said tip-plate assembly to said shell at the periphery of said proximal opening.

Said bonding can for instance be achieved by means of an adhesive or by welding.

In an embodiment of the method for manufacturing a hearing device with a tip-plate assembly comprising two optically distinguishable layers, preferably having different colours or different textures, the method further comprises the step of:

- adapting said tip-plate to a form of said shell by means of grinding, wherein said grinding is locally applied dependent on a visible colour or texture of said tip-plate.

It is expressly pointed out that any combination of the above-mentioned embodiments, or combinations of combinations, is subject of a further combination. Only those combinations are excluded that would result in a contradiction.

According to the present invention a receiver module and optionally a microphone module, e.g. an ear canal microphone, can be preassembled on a tip-plate thus forming a tip-plate assembly. Such a tip-plate assembly can then be easily mounted through a proximal opening in the custom shell and attached thereto for instance by gluing or by means of a mechanical snapping mechanism. Thus the "closing time", i.e. the time required to mount the receiver module into the shell during product assembly, can be reduced significantly. The manufacturing process is more cost efficient, since the tip-plate assembly can be preassembled separately beforehand, preferably as a high-volume part, and put into stock as a standard component. Subsequent hearing device assembly is thus considerably simplified by using a preassembled standard component. Such a hearing device then typically comprises a face-plate with e.g. a battery door, an ambient microphone and a user control element at its distal end and a tip-plate at the opposite proximal end.

By employing such a tip-plate assembly according to the present invention, the residual acoustic tubing extending from the receiver sound output port to the proximal sound opening of the shell or from the latter to the sound input port of the ear canal microphone is minimised or made obsolete altogether. This has the effect that the acoustic propagation delay from the receiver sound output port to the ear canal microphone input port is reduced. Furthermore, the arrangement of receiver and ear canal microphone with respect to one another is exactly defined thus providing a deterministic acoustic behaviour which is especially desirable when seeking to reduce the occlusion effect by means of active occlusion cancellation techniques based on monitoring the sound emitted by the receiver into the ear canal with the aid of the ear canal microphone.

Such a tip-plate according to the present invention can be optimised for a minimal cross-section and can thus help increase the fit rate. This is further supported by mounting the tip-plate from the exterior of the shell through the proximal opening in the shell, thus avoiding having to manoeuvre the receiver module (potentially along with the ear canal microphone) through the body of the shell from an opening at the broader distal end towards the narrower proximal end.

According to the present invention the receiver module is suspended within the seating aperture of the tip-plate by means of a suspension element. In this way the suspension of the receiver module can be designed and optimised according to specific requirements, e.g. to achieve high vibration damping in order to avoid feedback from the receiver to the ambient microphone. This is not possible with the conventional solution where the receiver is suspended by the acoustic tube. Vibration transmission from the receiver to the shell is minimised by clamping the receiver module at its front end (i.e. close to the sound output port) via the elastic suspension element, e.g. made of rubber or a rubber-like material, to the seating aperture of the tip-plate. This is achieved by arranging the suspension element at the front end of the receiver module such that it preferably entirely envelopes the receiver module in the vicinity of the seating aperture of the tip-plate. The cavity inside the shell into which the receiver module is inserted when the tip-plate is mounted through the proximal sound opening in the shell can be utilised as an extension of the back volume of the receiver in order to improve its acoustic properties, e.g. its low-frequency response. The cavity utilised as extended back volume can be designed according to the specific requirements of the user and then manufactured accordingly by producing the shell by means of a rapid prototyping process such as for instance selective laser sintering, stereolithography, photopolymerisation, fused deposition modelling or 3D printing. The acoustic output impedance and the frequency response of the receiver can be further adapted to specific needs with the help of an acoustical network in the extended back volume.

After the tip-plate has been attached to the shell, e.g. by gluing or welding, the form of the tip-plate is adapted to the form of the shell by grinding. This is performed manually by a person. In order to provide this person with some guidance as to when the minimal allowable thickness of the tip-plate has been reached, the tip-plate can be composed of two optically distinguishable layers, e.g. each with a different inner and outer colour or different inner and outer texture. As soon as the person sees the inner colour, he stops grinding any further.

Overall, the tip-plate according to the present invention provides a number of benefits in terms of improved acoustic coupling, increased fit rate and simplified assembly of custom hearing device products. The defined acoustic coupling for instance allows higher accuracy of the fitting precalculation for hearing aids, i.e. improved adjustment of hearing aid settings in order to provide optimal compensation of hearing impairments of hard of hearing persons. Moreover, a defined acoustic coupling is achievable which is essential for effective active occlusion cancellation. A higher fit rate is achievable due to improved positioning of the receiver (and the ear canal microphone) in the shell. The tip-plates can be preassembled in high volumes cost-efficiently and put into stock as a standard part for subsequent hearing device assembly. The assembly process for custom hearing devices is then significantly simplified by employing the preassembled tip-plates.

BRIEF DESCRIPTION OF THE DRAWINGS

The present invention is further described with reference to the accompanying drawings illustrating various exemplary embodiments which are to be considered in connection with the following detailed description. Thus, the present invention may be more readily appreciated. What is shown in the figures is the following.

DETAILED DESCRIPTION OF THE INVENTION

Figure 1:
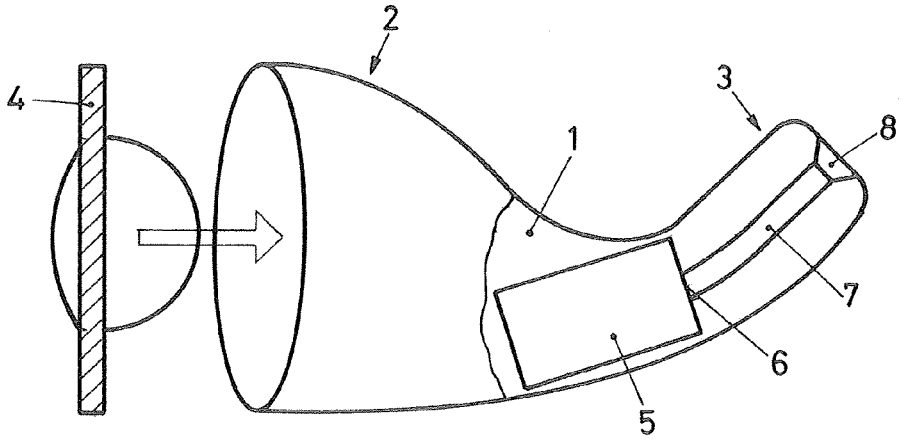
FIG. 1 depicts schematically a state of the art in-the-ear (ITE) hearing device.

FIG. 1 shows in a schematic representation a state of the art in-the-ear type hearing device comprising a shell 1 and a face-plate 4 to be attached to the distal end 2 of the shell 1. The shell 1 houses a receiver module 5 along with further components such as for instance a battery and electronic circuitry for audio signal processing and amplification. The sound output port 6 of the receiver module 5 is connected to a sound opening at the proximal end 3 of the shell 1 via an acoustic tube 7. The proximal sound opening is covered by a wax protection member 8 (also referred to as wax guard), which helps to avoid soiling of the receiver and the acoustic tube 7 by ear wax, sweat, etc. The receiver module 5 is conventionally inserted into the shell 1 through an opening at the distal end 2 of the shell 1. The final position of the receiver module 5 within the shell 1 is determined by the individual shape of the shell 1 and the positioning of the remaining components within the shell 1 depending on the skill of the person assembling the hearing device. The length of the acoustic tube 7 extending from the sound output port 6 of the receiver module 5 to the proximal opening in the shell 1 is dependent on the final position of the receiver module 5, whereby excess length extending beyond the proximal opening of the shell 1 is cut off. Consequently, the exact acoustic coupling conditions are not known. Once all the components have been introduced into the shell 1 the face-plate 4 is affixed to the periphery of the distal opening of the shell 1. The face-plate typically comprises a battery door, which allows exchanging of the battery housed within the shell 1, one or two microphone openings, which are in acoustic communication with one or two ambient microphones housed inside the shell 1, and one or more user control elements, e.g. for volume control and/or manual switching between hearing programs.

Figure 2:
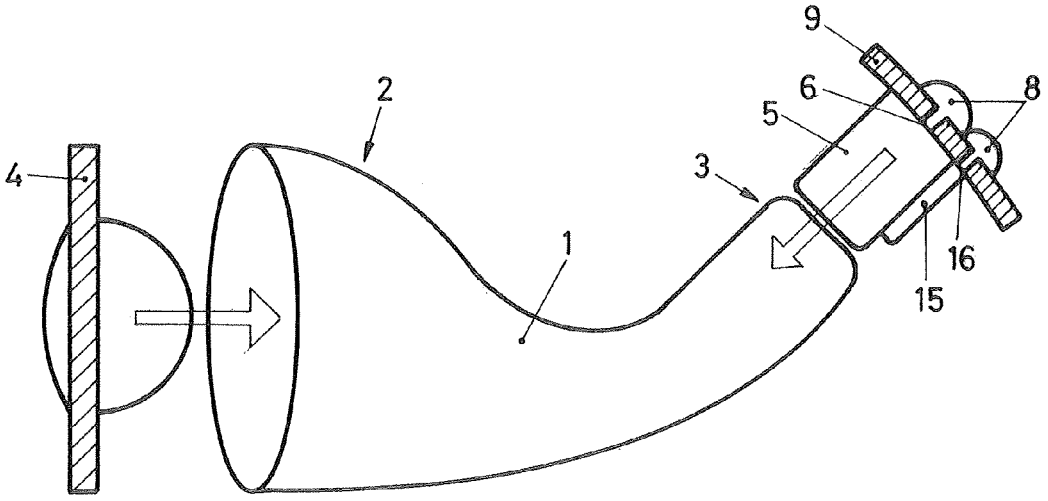
FIG. 2 depicts schematically an ITE hearing device according to the present invention.

FIG. 2 illustrates schematically an exemplary in-the-ear type hearing device according to the present invention. Here in addition to introducing a face-plate 4 into the distal end 2 of the hearing device, a tip-plate assembly is mounted into the proximal end 3 of the hearing device. The tip-plate assembly comprises a tip-plate 9 onto which a receiver module 5 and an ear canal microphone module 15 have been preassembled together with wax protection members 8. Since the receiver module 5 and the ear canal microphone module 15 are oriented in a defined manner with respect to the plane of the tip-plate 9, their position within the shell 1 is also exactly known once the contour of the proximal opening of the shell 1 onto which the tip-plate 9 is bonded has been specified as part of a 3D shell modelling process. As can be seen in FIG. 2, there is no need for an acoustic tube to connect to ports 6, 16 of the modules 5, 15 to the tip-plate 9 since both modules 5, 15 are directly mounted to the tip-plate 9.

Figure 3:
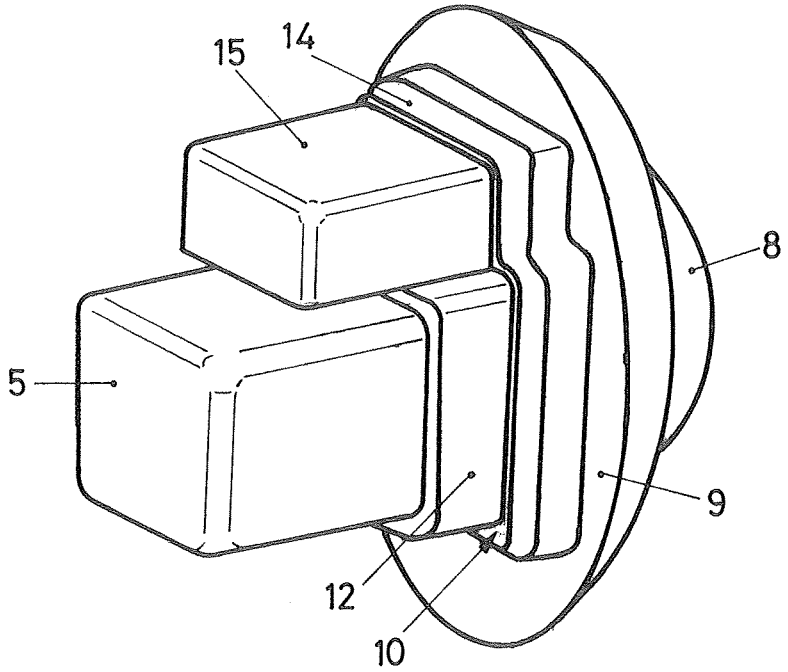
FIG. 3 depicts a perspective view of a preassembled tip-plate assembly according to the present invention.
Figure 4:
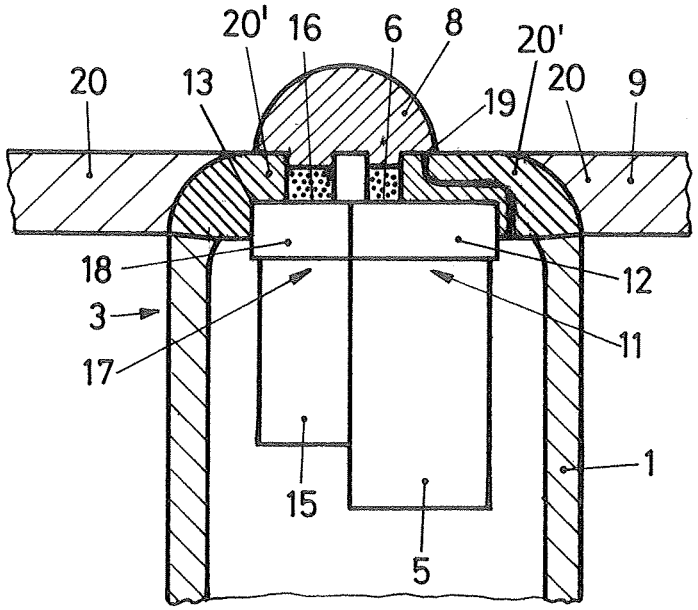
FIG. 4 depicts schematically a tip-plate assembly according to the present invention attached to an ITE custom shell before grinding off excess parts of the tip-plate.

An exemplary embodiment of a tip-plate assembly is depicted in FIG. 3. The tip-plate 9 is provided with a seating aperture 10 into which the receiver module 5 and the microphone module 6 are mounted. The receiver module 5 is completely enveloped at its front end 11 lateral perimeter by means of a suspension element 12. On the other hand the ear canal microphone module 15 is kept from being in direct contact with the receiver module 5 by a section of the suspension element 12, thus ensuring minimal transfer of mechanical vibrations from the receiver module 5 directly to the ear canal microphone module 15. Both modules 5, 15 are abutted against a shoulder 13 (as can be seen in FIG. 4). Secure mounting of the two modules 5, 15 within the seating aperture 10 is achieved by bracing them against the lateral wall of the shoulder 13 by means of the elastic suspension element 12, which also acts as a damper. The seating aperture is designed to conform to the front end 11 face of the receiver module 5 together with the anterior end 17 face of the ear canal microphone module 15. In order to further improve the fixation of the two modules 5, 15 within the seating aperture 10 the lateral wall of the shoulder 13 is extended thus forming a collar 14. The seating aperture 10 is covered at its outer side, i.e. the side exposed to the ear canal when the tip-plate assembly is mounted in a hearing device that is inserted into the ear canal, with a wax protection member 8.

FIG. 4 schematically illustrates a tip-plate assembly attached to the proximal opening of a hearing device before excess portions of the tip-plate 9 have been removed. As shown in FIG. 4 the tip-plate can also include a vent opening 19 and vent canal extending from the outside surface of the tip-plate 9 to the interior of the shell 1 (typically further extending through the shell 1 to a further opening at the distal end 2 of the hearing device). The vent opening is preferably also covered by a wax protection member 8. As can be seen in FIG. 4 a further suspension element 18 can completely envelope the anterior end 17 of the microphone module 15. Thus both modules 5, 15 and the shell are isolated from one another by means of the two suspension elements 12, 18. The tip-plate assembly can be glued, welded or snap-fitted by means of a mechanical snapping mechanism to the shell 1 at the periphery of its proximal opening. Excess portions of the tip-plate 1 are then removed for instance by means of grinding. A person performs the grinding process manually. In order to ensure that this person does not grind off too much of the tip-plate 9 it comprises two optically distinguishable layers, which for instance have distinct colours or exhibit different textures, one of which indicating areas where grinding is allowed and the other alerting to areas where grinding is prohibited. In this way the tip-plate 9 can be precisely adapted to conform to the outer surface of the shell 1.

It is to be noted that a tip-plate assembly as described above can also be used in conjunction with hybrid BTE/ITE type hearing devices, where the tip-plate assembly is then part of the ITE portion of the hearing device which is intended to be worn at least partly within an ear canal.

What is claimed is:

1. Hearing device for being worn at least partially within an ear canal, comprising a shell with a proximal opening and a preassembled tip-plate assembly, said preassembled tip-plate assembly comprising:

a tip-plate having a seating aperture;

a receiver module having a sound output port at a front end; and an elastic suspension element, wherein said suspension element at least partly envelopes said receiver module at said front end and said receiver module is mounted in said seating aperture by means of said suspension element to form a preassembled part;

said tip-plate assembly being arranged at said proximal opening of said shell, and said proximal opening being intended to face towards an ear drum when said hearing device is being worn and being adapted to allow introducing said preassembled tip-plate assembly from an exterior of said shell into said proximal opening.

2. The device of claim 1, wherein said seating aperture features a shoulder against which said front end and/or said suspension element are abutted.

3. The device of claim 1, wherein said seating aperture features a collar against which said front end and/or said suspension element are abutted.

4. The device of claim 1, further comprising a microphone module having a sound input port at an anterior end, said microphone module being mounted in said seating aperture at said anterior end.

5. The device of claim 4, wherein the suspension element and/or a further suspension element at least partly envelopes said microphone module at said anterior end and said microphone module is mounted in said seating aperture by means of said suspension element and/or said further suspension element.

6. The device of claim 5, wherein said suspension element and said further suspension element are integrally formed and said microphone module is jointly mounted with said receiver module in said seating aperture by means of said integrally formed suspension element.

7. The device of claim 4, wherein said receiver module and said microphone module are mounted in said seating aperture such that said receiver module and said microphone module are not in direct contact to one another.

8. The hearing device of claim 7, wherein said seating aperture features a collar against which said suspension element is abutted.

9. The hearing device of claim 8, wherein the collar surrounds the seating aperture, the receiver module, and the microphone module.

10. The device of claim 1, further comprising a wax protection member extending at least partly across the seating aperture.

11. The device of claim 1, further comprising a vent opening.

12. The device of claim 1, wherein the tip-plate comprises two optically distinguishable layers.

13. The device of claim 12, wherein the two optically distinguishable layers have different colours or different textures.

14. The hearing device of claim 1, wherein said tip-plate assembly is attached at a periphery of said proximal opening by means of an adhesive or a mechanical snapping mechanism.

15. The hearing device according to claim 1, wherein said hearing device is an in-the-ear, in-the-canal, completely-in-canal or hybrid behind-the-ear/in-the-ear type hearing device.

16. Method of manufacturing a hearing device according to claim 1, comprising the steps of:

manufacturing a tip-plate assembly comprising:

a tip-plate having a seating aperture;

a receiver module having a sound output port at a front end; and a suspension element, wherein said suspension element at least partly envelopes said receiver module at said front end and said receiver module is mounted in said seating aperture by means of said suspension element to form a preassembled part;

introducing said preassembled tip-plate assembly from the exterior of said shell into said proximal opening; and bonding said tip-plate assembly to said shell at the periphery of said proximal opening.

17. The method of claim 16 for manufacturing a hearing device with the tip-plate assembly, the tip plate further comprising two optically distinguishable layers, the method further comprising the step of:

adapting said tip-plate to a form of said shell by means of grinding, wherein said grinding is locally applied dependent on a visible colour or texture of said tip-plate.

* * * * *